United States Patent [19]

Artzt et al.

[11] Patent Number: 4,458,506

[45] Date of Patent: Jul. 10, 1984

[54] CIRCULAR KNITTING OR CIRCULAR HOSIERY KNITTING MACHINE FOR MANUFACTURE OF KNIT WARES OF HOSIERY WITH COMBED-IN FIBERS

[75] Inventors: Peter Artzt; Gerhard Egbers, both of Reutlingen; Helmut Grimm, Neckartailfingen; Klaus Kunde, Kohlberg; Anton Schenek, Bremen-Gröblingen; Adolf Seidel, Reutlingen, all of Fed. Rep. of Germany

[73] Assignee: Sulzer Morat GmbH, Fed. Rep. of Germany

[21] Appl. No.: 306,396

[22] Filed: Sep. 28, 1981

[30] Foreign Application Priority Data

Oct. 11, 1980 [DE] Fed. Rep. of Germany ..... 3038547
Feb. 28, 1981 [DE] Fed. Rep. of Germany ..... 3107714

[51] Int. Cl.[3] ..... D04B 9/14; D01G 15/40

[52] U.S. Cl. ..... 66/9 B; 19/105; 19/306

[58] Field of Search ..... 19/105, 306, 307; 66/9 B, 168

[56] References Cited

U.S. PATENT DOCUMENTS 3,014,355 12/1961 Hill ..... 66/9 B
3,295,337 1/1967 Beucus et al. ..... 66/9 B
3,768,119 10/1973 Wood ..... 19/306
3,916,485 11/1975 Doudlebsky et al. ..... 19/105 X
4,067,181 1/1978 Fehrer ..... 19/105 X
4,109,453 8/1978 Kobayashi et al. ..... 19/105 X
4,258,454 3/1981 Wilson et al. ..... 19/105

FOREIGN PATENT DOCUMENTS 2013704 10/1970 Fed. Rep. of Germany ..... 19/105
2319728 4/1977 France ..... 66/9 B

*Primary Examiner*—Wm. Carter Reynolds

[57] ABSTRACT

Circular knitting machine for the manufacture of knit wares of hosiery with combed-in fibers, having at least one needle bed possessing knitting needles and having at least one carding machine which possesses a feed apparatus for a band of fibers, a combing-in zone, through which the knitting needles pass, for the contact less insertions of fibers into the knitting needles, and a separating apparatus for separating the band of fibers into individual fibers. The separating device comprises a separating drum that can be driven at high peripheral speed and is provided with a fitting (card wires) for which a drive mechanism is provided that is independent of the knitting machine drive mechanism. Opposite the peripheral surface of the separating drum is a cover which possesses an entrance opening for the band of fibers brought by the feed device and an exit opening for the separated fibers that opens into the combing-in zone, and which encloses the fitting, (card wires) in a separating and accelerating section disposed in the direction of rotation between the entrance opening and the exit opening, so closely that a detachment of the fibers in this separating and accelerating section is prevented.

23 Claims, 12 Drawing Figures

Figure 1:
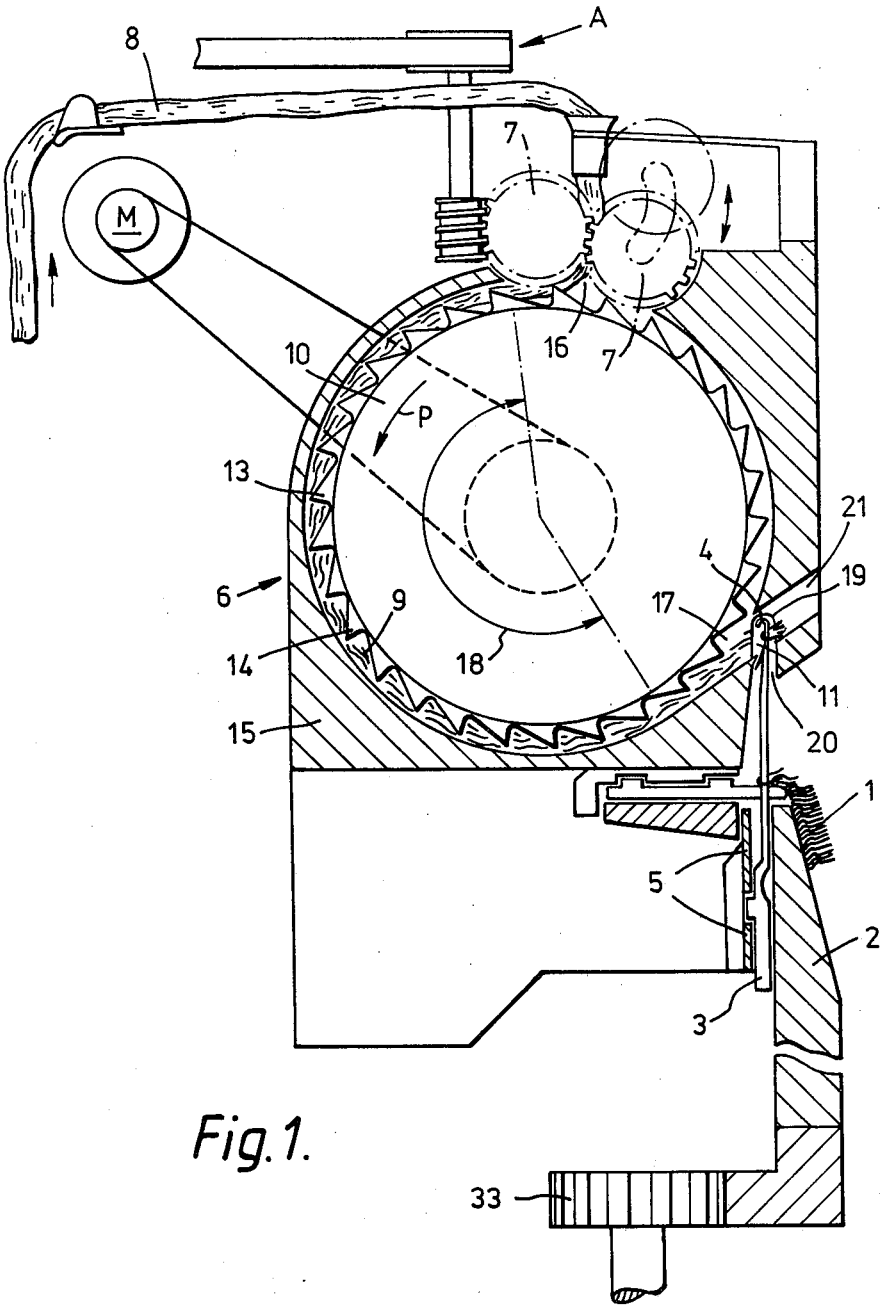

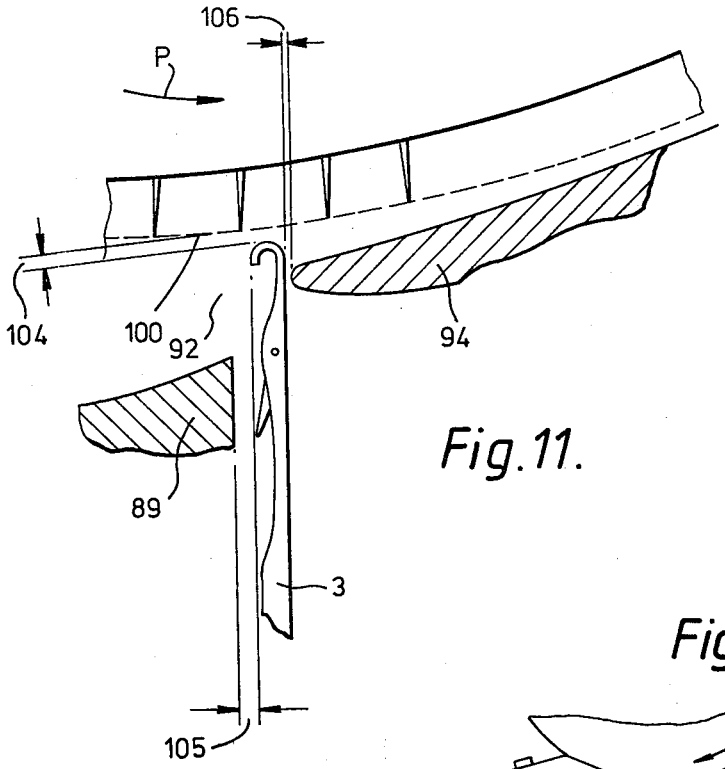
Fig. 11.
Fig. 12.
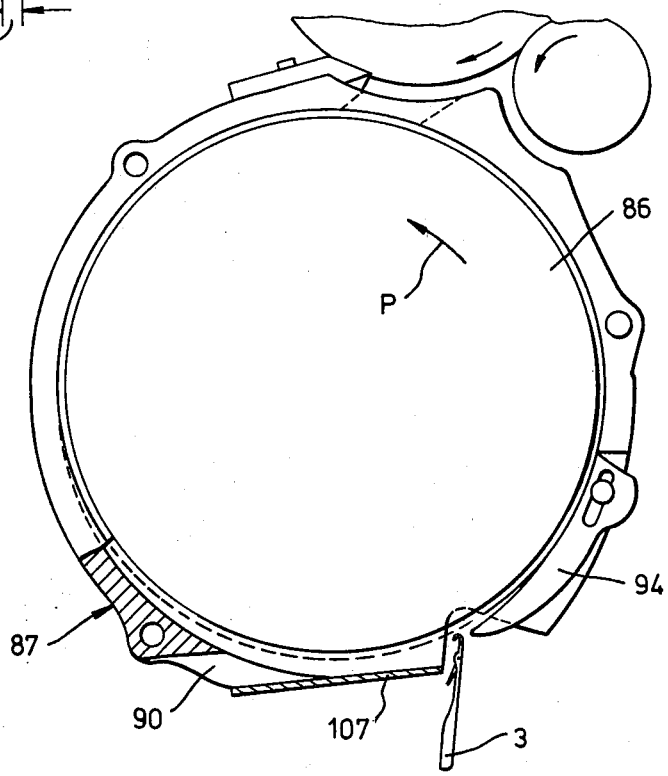

CIRCULAR KNITTING OR CIRCULAR HOSIERY KNITTING MACHINE FOR MANUFACTURE OF KNIT WARES OF HOSIERY WITH COMBED-IN FIBERS

The present invention concerns a circular knitting machine for the manufacture of knit goods or hosiery with combed-in fibres, with at least one needle bed possessing knitting needles and with at least one carding machine which possesses a feed apparatus for a band of fibres, a separating apparatus for separating the band of fibres into individual fibres and a combing-in zone, through which the knitting needles pass, and in which the fibres are inserted contactlessly.

Carding machines of all knitting machines hitherto used for industrial purposes contain at least one separating or carding drum, to which a band of fibres is fed, and a doffing or combing-in drum for taking off the fibres prepared by the separating drum and combing them into the knitting needles needles. In this case both the separating drum and the combing-in drum are furnished with flexible fittings (card wire means) in the form of rubber cloths secured to the outer surfaces of the drums and having radially projecting, flexible wire hooks worked into them. The wire hooks of the separating drum and of the combing-in drum mesh with each other more or less to a certain depth so that the fibres can be transferred from the separating drum to the combing-in drum. The transfer of the fibres from the combing-in drum to the knitting needles is accomplished by having the hooks of the latter guided along a helical path through the wire hooks of the combing-in drum. Nothing in this basic concept of carding for knitting machines for the producton of knit goods or hosiery with combed-in fibres has changed since the first suggestions therefor such as in DE-PS No. 383 362 and U.S. Pat. Nos. 3896636 and 3896637.

The mechanical engaging of the wire hooks of the combing-in drum with the wire hooks of the separating drum and of the hooks of the knitting needles with the wire hooks of the combing-in drum, despite the flexibility of these wire hooks, results in high mechanical wear, on the one hand, which is increased still further by the additional engaging of wire hooks of worker and reversing (clearer) drums as well as cleaning and smoothing drums with the wire hooks of the separating or combing-in drums. The fittings of said drums and the knitting must therefore be frequently replaced, resulting in prolonged shut-downs of the knitting machine and high material costs. On the other hand, mechanical engagement means that the r.p.m.'s of separating drum and combing-in drum cannot be adjusted, as desired, freely and independently of each other, since for example a high separating drum r.p.m., which is desirable in order to achieve a good separation of fibres, is restricted by the fact that the r.p.m. of the combing-in drum must always be comparatively low, on the one hand, in the interest of an even combing of fibres into the knitting needles, while on the other hand, on account of the required transfer of fibres from the separating drum it must always be set higher than the r.p.m. of the latter. Furthermore, the uniformity of fibre insertion into the knitting needles is unsatisfactory owing to the known build-up effect of the combing-in drum.

Therefore circular knitting machines have already become known which possess devices for the contactless combing-in of fibres into the knitting needles, where "contactless" means that the hooks of the knitting needles, on the one hand, do not pass through a fitting (carding cloth), nor on the other hand, are there drums provided that posses fittings with meshing wire hooks for the conveyance or uniformization of the fibres.

In a design disclosed in GB-PS No. 195 802 of this kind a conveyer duct is provided in which a flow of air is maintained for conveyance of the fibres and which possess a combing-in zone in the form of an opening through which the hooks of the needles pass. The entrance to this conveyor duct is connected to a separating apparatus for the separation and singling of the fibres and having the form of a separate compartment to which the fibres are fed in a coherent band of fibres and from which they are removed again by compressed air. For transferring the fibres suspended in the compartment into the conveyor duct a conveyor belt, for example, is provided.

Another design disclosed in U.S. Pat. No. 3 014 355 also provides a conveyor duct for combing the fibres into the knitting needles and in which a flow of air is maintained for the conveyance of the fibres. Unlike the design described above, the open end of the conveyor duct is placed just ahead of the passing hooks of the knitting needles, while a band of fibres is fed by ordinary feed rolls to an entrance opening of the conveyor duct.

Neither the above-described or other knitting machines or hosiery knitting machines with contactless fibre input such as disclosed in DE-PS Nos. 97 374 and 1 585 018, DE-AS No. 17 85 465 and DE-OS Nos. 22 53 659, and 24 30 867 and U.S. Pat. No. 3996770 have ever found acceptance in knitting or hosiery knitting technology or in the industrial application thereof. This is probably because a satisfactory separation of the fibres and hence a uniform combing of fibres, associated with low losses, into the knitting or hosiery knitting needles can not be achieved with the aid of separate separating compartments, or with the simple feeding of a band of fibres into a conveyor duct with air blowing through it, or with the feeding in just of a slubbing into the combing-in zone.

However, since the need for knitting machines with contactless fibre input is very great in view of the described difficulties in the machines actually in use, the basic object of the invention is to improve the knitting machine of the kind initially described so that it is industrially applicable and affords a uniform combing-in of fibres into the hooks of the knitting needles with low losses of fibres.

According to the present invention there is provided in a circular knitting machine for the manufacture of knit goods or hosiery with combed-in fibres, with at least one rotary needle cylinder possessing knitting needles and with at least one carding machine which possesses a feed apparatus for a band of fibres, a separating apparatus for separating the band of fibres into individual fibres and a combing-in zone, through which the knitting needles pass, and in which the fibres are inserted contactlessly, the improvement in which the separating apparatus comprises a separating drum having card wire means and for which a drive mechanism independent of the knitting machine drive mechanism is provided, and whose r.p.m. is so selected that its peripheral speed is greater than the needle speed effected by rotation of the needle cylinder, and a cover opposite the peripheral surface of the separating drum which cover has an entrance opening for the band of fibres carried by the feed apparatus and an exit opening for the separated fibres that opens into the combing-in zone which cover so closely embraces the fitting (card wire means) in a separating and accelerating section between the entrance opening and the exit opening in the direction of rotation, that detachment of the fibres in this separating and accelerating section is prevented.

Desirably, a detachment section, also embraced by the cover, is provided between the separating and accelerating section and the exit opening. The detachment section suitably has a radial distance from the separating drum that at first increases starting at the separating and accelerating section, and then in the direction of the exit opening remains constant or decreases and a part of the detachment section adjacent the exit opening is suitably a ramp.

The cover suitably possesses another opening for generating a stream of air passing through the detachment section in the direction of the combing-in zone and promoting or effecting the detachment of the fibres and this stream of air desirably has a flow velocity that is greater than the peripheral speed of the separating drum. Suitably the opening is in the region of the detachment zone and is connected to a blowing nozzle and is a slit opening extending over the width of the peripheral surface of the separating drum.

The cover in one embodiment of the present invention is part of a housing enclosing the separating drum on all sides at least between the entrance opening and the exit opening. The cover or housing suitably has an extension, which is a hold-down part, that extends out beyond the combing-in zone and also suitably an expansion, which is a cover part, extending out beyond the combing-in zone.

The present invention affords the advantage that the separating apparatus, despite the use of an essentially conventional separating drum, and one that is desirable for the attainment of a good fibre separation, comprises a compact structural unit, the dimensions of which exceed only slightly the dimensions of the separating drum itself. Furthermore, short conveyance paths, free of deflections, are produced which facilitate a uniform input of fibres, since the combing-in zone can be placed at a point immediately behind the exit opening and therefore the singled fibres can be inserted almost immediately after detachment from the separating drum into the knitting or hosiery knitting needles. Further, an optimum separation of the band of fibres into individual fibres is achieved because the separating drum can be driven at a high r.p.m. which is at least about four times greater in comparison with the peripheral speeds of the separating drums in traditional knitting or hosiery knitting machines. Furthermore, the uniformization of the fibre input is also substantially improved by the fact that at these high peripheral speeds, owing to the resulting high centrifugal forces, an almost complete detachment of the fibres is achieved within the exit opening or detachment zone, on the one hand, especially if the fitting (card wire means) of the separating drum is produced from short hooks that are as rigid as possible, so that the separating drum cannot act as an accumulator of fibres, while on the other hand a flow of air is automatically produced which suffices in order to convey the detached fibres over the relatively short distance from the exit opening or detachment section to the combing-in zone. If the centrifugal forces and/or flows of air generated by the rotation of the separating drum should not suffice for this purpose, then in the detachment section and/or in the combing-in zone, additionally or alternatively, an auxiliary stream of air can be produced in order to improve or bring about the detachment of the fibres and their conveyance. Another advantage of the knitting machine of the present invention is that the conveyance of the fibres from the entrance opening to the combing-in zone of the separating apparatus takes place in a very short time and without a build-up effect, so that by controlling the feed rate of the band of fibres abrupt changes of fibre density in the finished knit goods or hosiery can be produced. Finally, shortwave fluctuations of the fibre density in the input band of fibres are smoothed out in an advantageous way by a high backdoubling effect. This is a consequence of the substantially higher peripheral speed of the separating drum in comparison with the usual transport speed of knitting needles.

To improve the uniformity of the fibre input and reduce the fibre losses, especially where comparatively short fibres are used, it is provided in a further improvement of the invention to develop the part of the cover behind the combing-in zone in the direction of rotation of the separating drum.

Thus in a particular embodiment of the present invention the cover has an air and fibre guiding section disposed behind the combing-in zone, which section has a forward end towards the combing-in zone that acts as a separating edge dividing the stream of air emerging from the exit opening into a main stream to the atmosphere and a secondary stream passing between the guiding section and the separating drum and has a guiding surface facing towards the separating drum and acting as an orientating and combing surface for the inserted tufts of fibre. Desirably the forward end of the guiding section on the side towards the combing-in zone has a radial distance from the separating drum that is less than the corresponding distance of a part of a detachment section adjacent to the exit opening and is greater than the corresponding distance of the separating and accelerating section, and the rearward end of the guiding section on the side towards the combing-in zone has a radial distance from the separating drum that is substantially equal to the corresponding distance of the separating and accelerating section. Preferably part of the guiding surface situated between a forward end and a rearward end has a radial distance from the separating drum that decreases gradually from the forward to the rearward end. Suitable, the guiding section which is desirably shiftably mounted has a length that is adapted to the maximum length of the fibres to be processed and has a rounded forward end, the side facing the combing-in zone, the forward end having a radial distance from the separating drum which at a maximum corresponds to a third of the corresponding distance of the part of a detachment section adjacent to the exit opening. The guiding section desirably comprises a flap, a rearward end of which remote from the combing-in zone is swivellably mounted.

Surprisingly, this has the effect that almost all the fibres fed to the combing-in zone are inserted into the hooks of the knitting needles and are disposed during their passage through the combing-in zone in the region between the guiding surface and the separating drum. This has the advantage that the beards of the tufts of fibres hanging in the needles are oriented uniformly without the need to provide special blowing or suction nozzles that would increase the fibre losses. If at the same time the guiding surface, according to an especially advantageous feature of the invention, is so placed that its forward end on the side of the combing-in zone has a radial distance from the separating drum which is less than the corresponding distance of the part of the detachment section bordering on the exit opening, but is greater than the corresponding distance of the separating and accelerating section, and that its rearward end on the side of the combing-in zone has a radial distance from the separating drum that is substantially equal to the corresponding distance of the separating and accelerating section, then the ends of the tufts of fibre reach gradually into the effective range of the separating drum fitting and are therefore engaged by its tips and combed smooth. The result is an extremely uniform fibre input and an extremely uniform fibre density in the finished knitted texture. At the same time the fibre losses observed, even when very short fibres are employed, are comparatively small.

Figure 2:
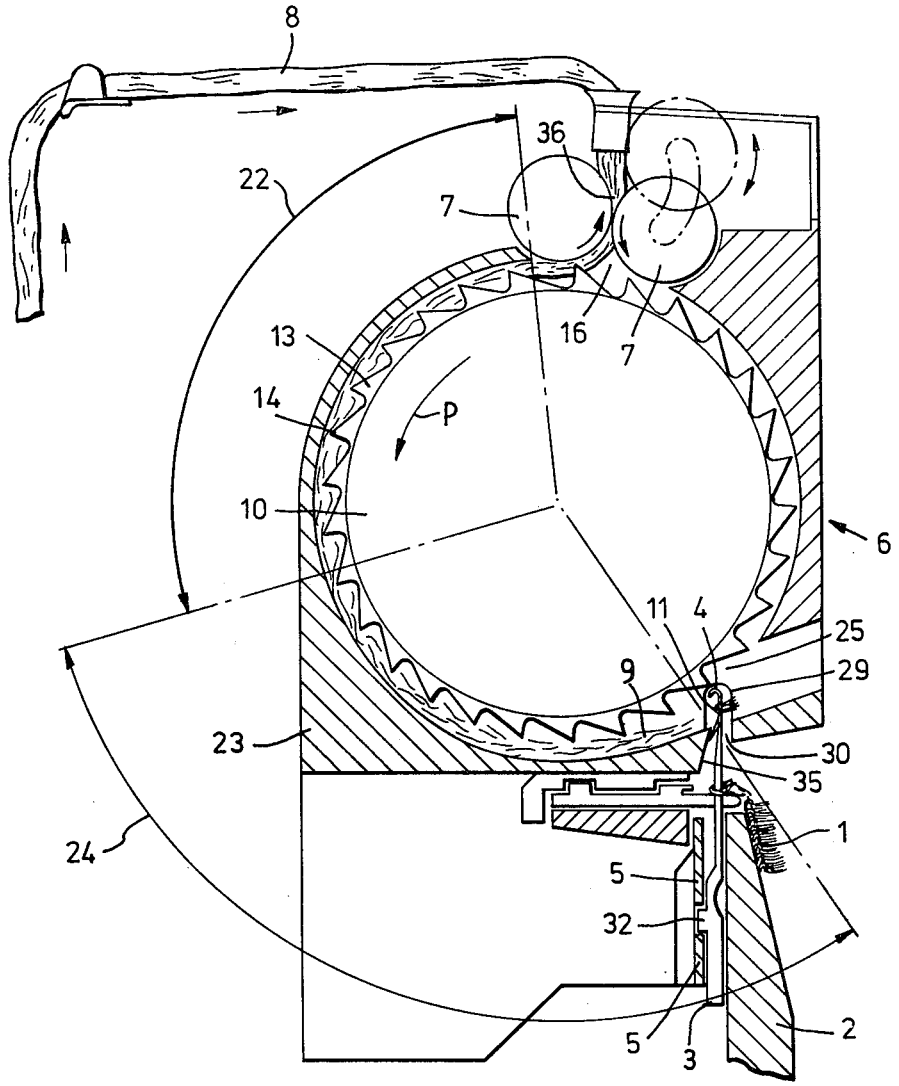

The present invention will be further described with reference to the accompanying drawings of a circular knitting machine in which:

FIGS. 1 and 2 are schematic longitudinal sections through circular knitting machines with two embodiments of the separating apparatus according to the invention.

Figure 3:
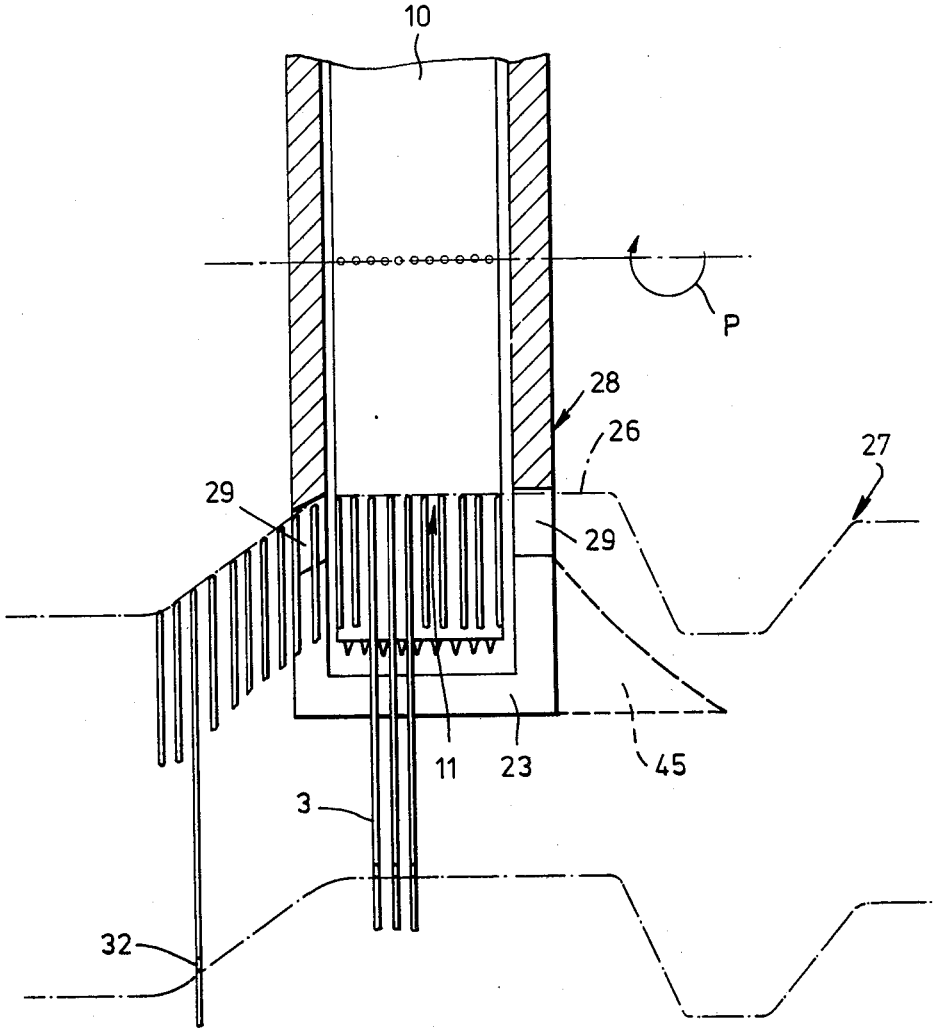
Figure 4:
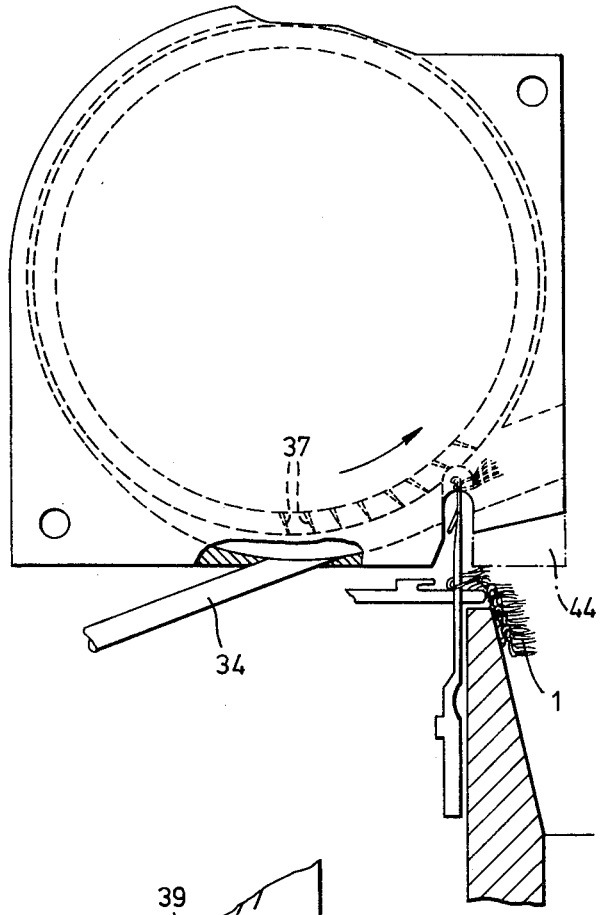
Figure 5:
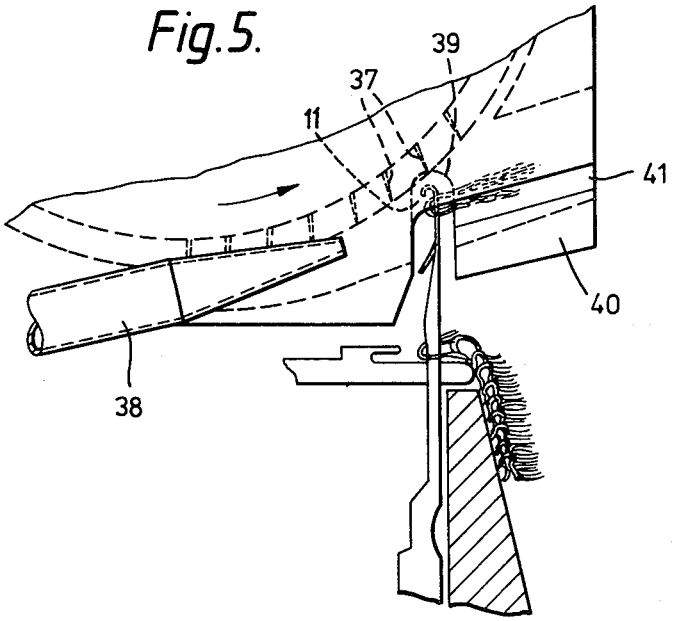
Figure 6:
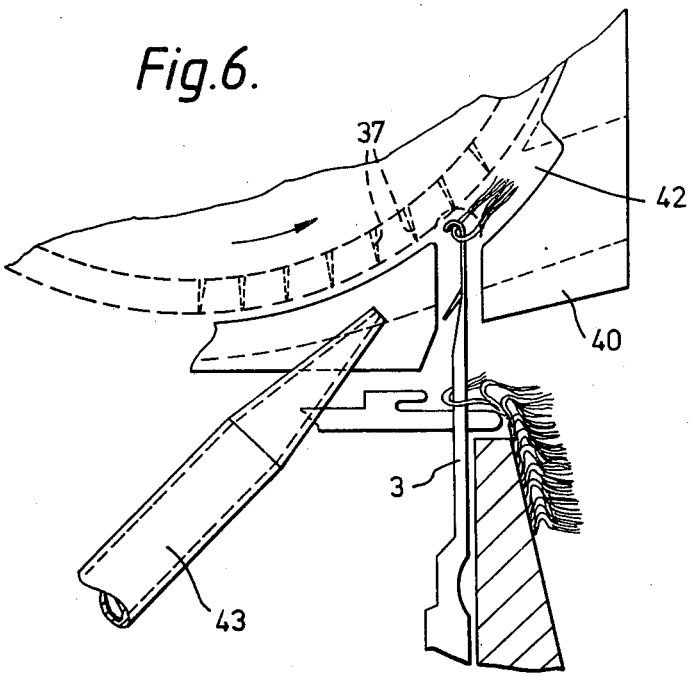
Figure 8:
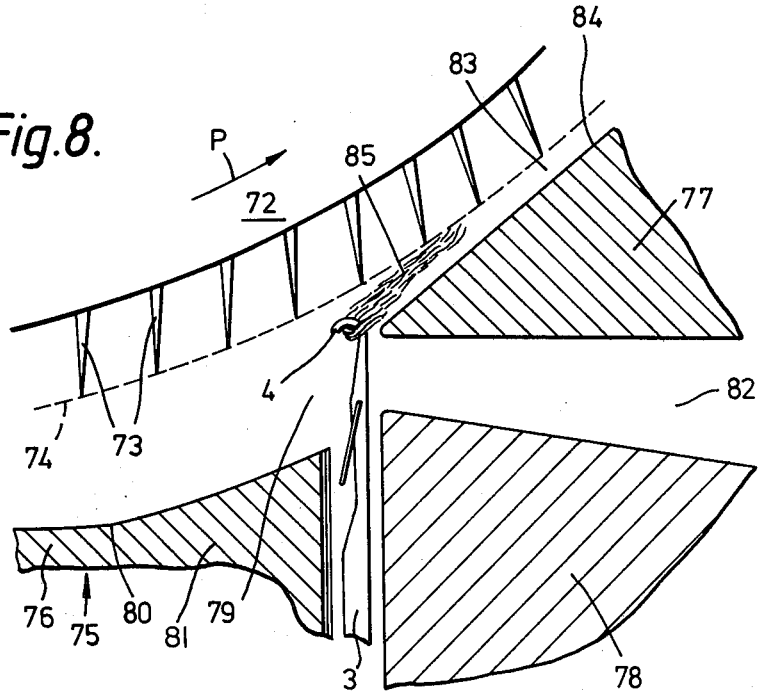
Figure 7:
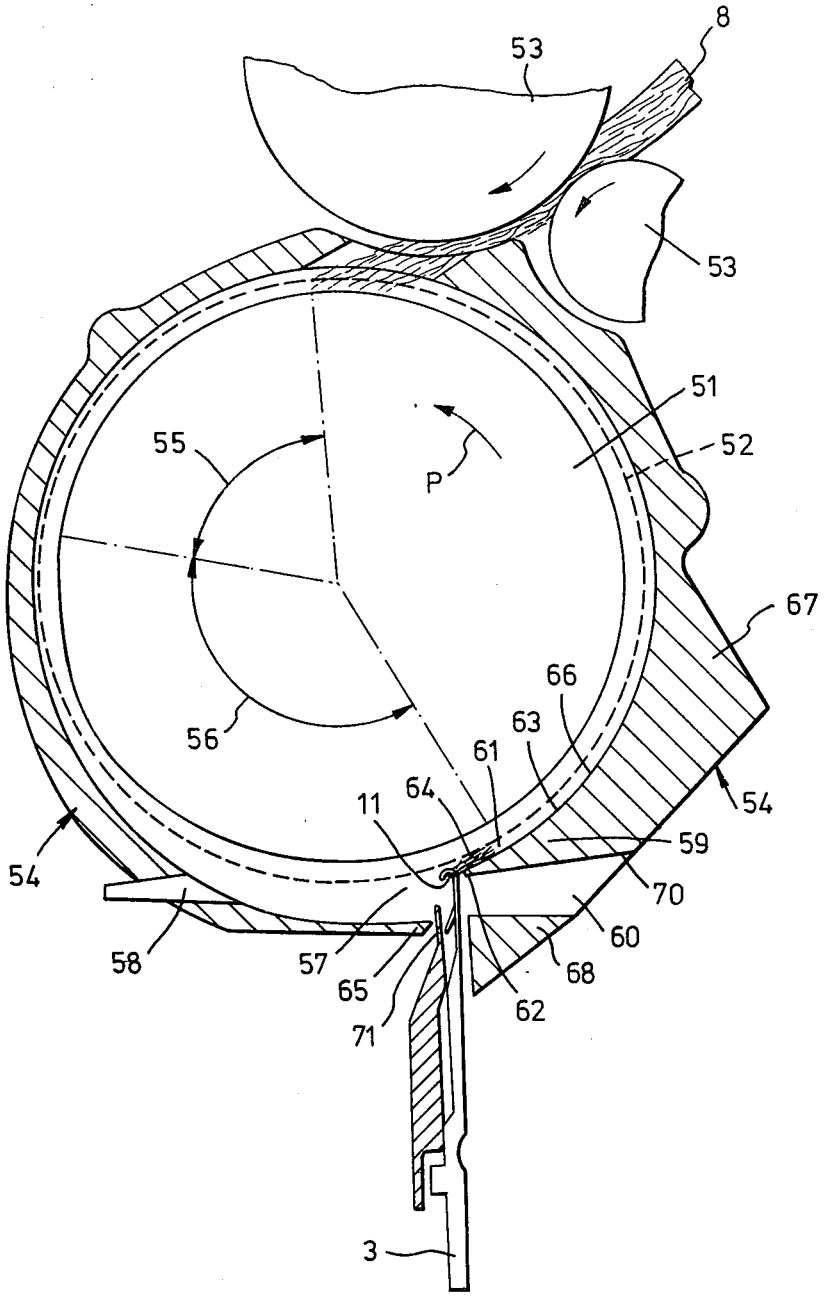
Figure 9:
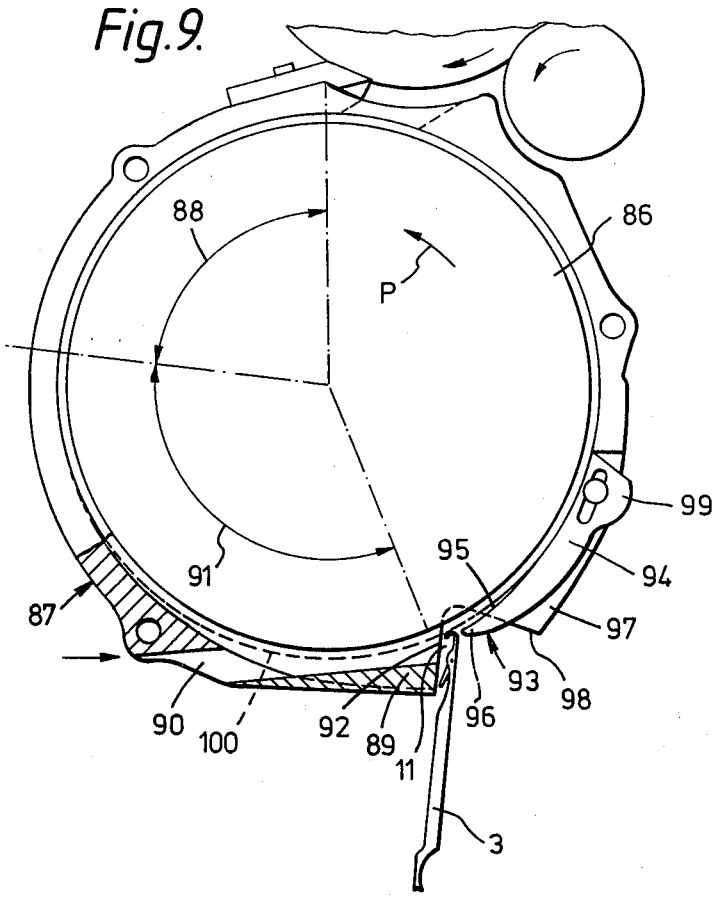
Figure 10:
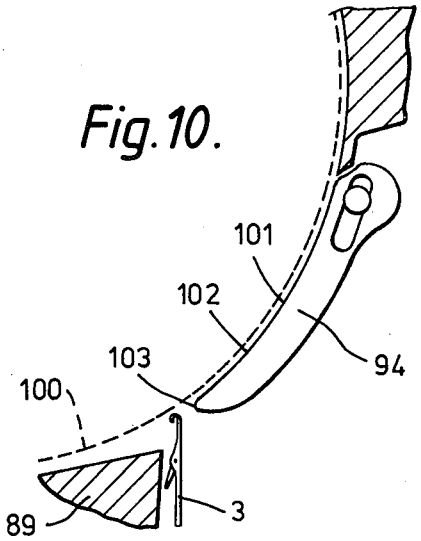

FIG. 3 represents a circular knitting machine according of FIG. 2 schematically with a view of the path passed through by the knitting needles, FIG. 4 represents a schematic rear view of a third embodiment of the separating apparatus according to the invention, FIGS. 5 and 6 are the schematic rear views of a fourth and fifth embodiment of the separating apparatus of the invention, FIG. 7 is a schematic longitudinal section through the fourth embodiment of the invention of FIG. 5, FIG. 8 is an enlarged segment of another embodiment of the invention in a view corresponding to that of FIG. 7, FIG. 9 is a partially sectioned frontal view of a seventh embodiment of the invention, FIGS. 10 and 11 are details of the embodiment according to FIG. 9, and FIG. 12 is an illustration of an eighth embodiment of the invention corresponding to FIG. 9.

According to FIG. 1 a circular knitting machine for the production of knit goods 1 with combed-in fibres contains a needle cylinder 2, generally rotatable, in which vertically movable knitting needles 3 with hooks 4 are supported, which needles are moved up and down in the region of at least one knitting system with the aid of stationary cam parts 5 in order to produce, with threads that are not represented, a basic knitting stitch. The separation and combing of the fibres into the knit goods is accomplished with at least one carding mechanism 6 assigned to the knitting system, said mechanism possessing a feed device consisting e.g. of two feed rolls 7 for a roving or band of fibres 8, a separation apparatus in the form of a separating drum 10 intended for separation of a band of fibres 8 into individual fibres 9, and a combing zone 11 which the knitting needles 3 or their hooks 4 pass through for the purpose of engaging fibres 9.

The separation of the band of fibres 8 is accomplished by means of a separating drum 10 that is rotatable in the direction of an arrow P, its peripheral or outer surface being provided with a fitting or card wire means 13 which has outwardly projecting hooks 14. Separating drum 10 is driven at a considerably faster peripheral speed compared with that of feed rolls 7 and therefore separates a band of fibres 8 into individual fibres 9. In order to prevent accumulations or losses of fibres from occuring at the sides of separating drum 10 the width of the peripheral surface of separating drum 10 should be greater than the width of the fibre band 8 being fed in. In addition a guide plate, not shown, can be provided which lies tangentally against band of fibres 8 and in the direction of rotation of separating drum 10 in its peripheral surface.

So that the fibres engaged by hooks 14 of fitting 13, despite the considerably effective contrifugal forces caused by the high r.p.m. of the separating drum, are not hurled out of hooks 14, carding mechanism 6 has a cover 15 which lies adjacent to the external outer surface of separating drum 10, this cover containing an entrance opening 16 for the band of fibres 8 brought by feed rolls 7 and an exit opening 17 opening into combing-in zone 11 and situated behind separating drum 10 in the direction of its rotation, and being closed at least from the entrance opening to exit opening 17. Cover 15 thereby defines a separating and accelerating section 18 on the outside starting directly at entrance opening 16, ending at exit opening 17, and indicated in FIG. 1 by an arrow, the distance between cover 15 and the tips of hooks 14 in this area being so small that the fibres engaged at entrance opening 16 by hooks 14 are retained by hooks 14 and are conveyed onwards without producing accumulations of fibres between conver 15 and hooks 14 or without fibres being removed from conveyance by reason of loose fibres being detached prematurely from the hooks owing to the centrifugal force. At exit opening 17 following the accelerating and separating section 18, however, the fibres can break away from hooks 14 under the influence of the centrifugal force. These detached fibres, in the stream of air which develops automatically between cover 15 and the outer surface of separating drum 10 on the one hand and between entrance opening 16 and exit opening 17 on the other hand follows the direction of arrow P, are thrown off essentially in a tangential direction and are conveyed at least through the combing-in zone immediately following exit opening 17, which is passed through by hooks 4 and knitting needles 3.

Cover 15, according to FIG. 1, is suitably part of a housing that encloses separating drum 10 and combing-in zone 11. The side walls of this housing each possess U-shaped openings 19 both at the entrance and at the exit of combing-in zone 11, while a slot 20 preferably transverse to the direction of conveyance of the fibres is provided in the floor of the housing. Openings 19 and slot 20 are in a part of the housing that, in the direction of rotation of separating drum 10, is adjacent in the form of a tangential flow channel 21, to exit opening 17 of cover 15 and embraces the flight path of fibres 9 after their passage through exit opening 17. Because of this design, combing-in zone 11 can be placed in the immediate vicinity of the circumference of the separating drum, but somewhat distant therefrom, without hooks 4 of knitting needles 3 coming into contact with hooks 14 of fitting 13.

FIG. 2 shows a second embodment of the invention in which the same parts are given the same reference numbers. Unlike FIG. 1, a separating and accelerating section 22, indicated by an arrow, within which cover 23 is at a small yet constant distance from the tips of hooks 14 of separating drum 10, extends over only about one quarter of the perimeter of separating drum 10. Following upon the separating and accelerating section 22 in the direction of rotation of separating drum 10 is a detachment section 24, indicated by an arrow, which also extends over about one quarter of the perimeter of separating drum 10 and terminates at the beginning of an exit opening 25 for fibres 9. The fibres can therefore be detached from hooks 14 over a comparatively long section of the perimeter before being thrown off in an essentially tangential direction through exit opening 25 adjoining combing-in zone 11.

Combing-in zone 11 according to FIGS. 2 and 3 consists of a segment 26, extending transversely to the direction of conveyance of fibres 9, of a path 27 which is transversed by the top ends of hooks 4 on knitting needles 3 during the usual rotation of needle cylinder 2. Cover 23 is preferably part of a housing 28 which encloses separating drum 10 on all sides and the side walls of which possess U-shaped openings 29 at the start and finish of section 26 respectively, the top edges of which openings may ascent slightly or be made straight in order to retain adaptation to the not yet completed extension or not yet started retraction of knitting needles 3 at the passing of cover 23, while in the floor of cover 23 only on transverse slot 30 (FIG. 2) is provided. Section 26, moreover, is parallel to the axis of separating drum 10 and is given a height such that hooks 4 of knitting needles 3 do indeed come as close as possible to hooks 14 of separating drum 10, but do not touch them. The result of this is that only very few fibres 10 can escape unused through the space between hooks 4 and 14. The shape of path 27 depends on the shape of cams 5 which act on the butts 32 of knitting needles 3 that follow a path 31. Differing from FIG. 3, it may be provided that knitting needles 3, on reaching cover 23, are already fully extended. During their passage through combing-in zone 11 the open parts of hooks 4 of knitting needles 3 are turned towards the rearward end of detachment section 24, seen in the direction of rotation of the separating wheel.

According to FIGS. 1 to 3 both entrance openings 16 and combing-in zone 11 are placed directly at the perimeter of separating drum 10, so that only separating drum 10 is required for the entire separating and combing-in process. As a consequence, on the one hand the otherwise customary operator and turner drums and the separately provided doffer rolls can be dispensed with. At the same time the travel of fibres from entrance opening 16, where they are still anchored within fibre band 8, to combing-in zone 11 where fibres 9 are inserted into hooks 4 of knitting needles 3, is extremely short, so that desired changes of fibre density, e.g. owing to the application of different fibre bands, become apparent at the input zone in the knitting very quickly indeed owing to the corresponding changes in the weight of the goods. Moreover, since there are no points of deflection or other obstacles for the fibres provided between separating drum 10 and knitting needles 3, the uniformity of the fibre input is very great.

Separating drum 10 always has a drive mechanism M (FIG. 1) that is independent of the regular needle cylinder drive mechanism 33 (FIG. 1), and the former drives separating drum 10 at an r.p.m. that remains constant at all knitting machine speeds, or at a speed that, within certain limits, can be adapted to the knitting machine speeds at any given time and/or to the properties of the fibres being introduced. In any case, the peripheral speed of separating drum 10 in operation is relatively high compared with the peripheral speeds of the usual separating drum peripheral speed that are synchronized with the knitting machine speed and coact with a doffing drum, and are preferably at least about 4 to 10 times greater, referred to the maximum r.p.m. of needle cylinder 2. The peripheral speed of separating drum 10 in absolute terms is preferably greater than 15 m/sec at needle cylinder peripheral speeds of about 1.5 m/sec maximum. Feed rolls 7, on the other hand, are driven by a drive mechanism A (FIG. 1) synchronously with the r.p.m. of the needle cylinder and in the case of the above example would have peripheral speeds which at the maximum cylinder r.p.m. would be at least about 100 times less than the peripheral speed of separating drum 10. At the same time the feed rate of feed apparatus 7 can be varied as a function of the weight of the goods. Owing the the great difference between the feed rate of band of fibres 8 and the peripheral speed of separating drum 10 a considerable stretch is attained in band of fibres 8 and hence an extremely good separation of individual fibres.

The centrifugal forces arising because of the high r.p.m. or peripheral speeds of separating drum 10 normally suffice, in the described embodiment, to detach the fibres held by hooks 14 one hundred percent within exit opening 17 or within the detachment segment 24 owing solely to the centrifugal force. This is a condition that must be aimed at in order to avoid build-up effects and to attain great uniformity with respect to the density of the combed-in fibres. However, since the centrifugal forces do not always suffice for this purpose, in cover 23 according to FIG. 4, which otherwise corresponds to that of FIG. 3, an additional opening is provided in the region of detachment section 24 which is expediently a slit that extends over the entire width of separating drum 10. This opening is connected to a blower nozzle 34 through which an auxiliary current of air can be blown into detachment section 24 in order to reinforce the detaching of fibres from hooks 14 of separating drum 10 or, if the centrifugal forces produced by the rotation of separating drum 10 are too small, to effect the detachment by itself. The auxiliary current of air, by suitable designing and placing of the opening and of the blower nozzle 34, is expediently directed tangentially relative to separating drum 10 and in the direction of rotation of its peripheral surface at this point, so that the fibres are not forced into the hooks 14 of separating drum 10, but are stripped away from them, and the current of air should have a velocity that is greater than the peripheral speed of separating drum 10. Instead of blower nozzle 34 connected to a source of compressed air, or even additionally thereto, a duct connected to a source of suction air can be provided which is expediently placed at the rearward end, seen in the direction of rotation of separating drum 10, of combing-in zone 11.

Covers 15 or 23, as the case may be, as FIGS. 1 to 3 show, are expediently designed as parts of a housing that narrowly encloses separating drum 10 on all sides, that possesses only entrance opening 16 for the input of band of fibres 8, may possess the opening connected to blower nozzle 34, and possesses exit opening 17 or 25, as the case may be, and openings 19 or 29, as the case may be, required for passage of hooks 4 of knitting needles 3, and slots 20 or 30, as the case may be. Exit openings 17 and 25 or ducts connected thereto may at the same time serve to conduct the current of air and to remove residual fibres not combed in combing-in zone 11, which are thus ineffectively consumed. The axes of exit openings 17 and 25 should be placed tangentially relative to the peripheral surface of separating drum 10 in order to prevent troublesome air vortices.

A part 35 of cover 23 (FIG. 2) bordering on exit opening 25 and facing open hooks 4 of knitting needles 3 is expediently so designed that it terminates just above the open needle latches and thereby prevents closing of the needle latches within combing-in zone 11, on the one hand, and ensures that the detached fibres can be placed only in the open needle hooks 4, turned towards the stream of fibres, but not around the shafts of knitting needles 3 situated below hooks 4, on the other hand.

If slide needles or tubular needles are used this measure is unnecessary.

Feed rolls 7, as indicated in FIG. 1, are arranged adjustably in such a way that the distance of gap formed between them from the axis of separating drum 10 can be adapted to the particular given staple length of the fibres in incoming band 8. The adjustment should be so chosen that the distance of gap 36 from the place at which band of fibres 8 is engaged by hooks 14 of separating drum 10 is about equal to the average staple length.

The length, measured in the direction of rotation of separating drum 10, of separating and accelerating section 18 or 22 as the case may be, and especially of detachment segment 24, should be at least equal to the maxinum staple length to be dealt with, so that the detaching process is only begun when the fibres lie with their entire length on separating drum 10, or so that the detaching process is completed before the separated fibres 9 are inserted into hooks 4 of knitting needles 3. If necessary, several interchangeable separating drums 10 and covers 15 or 23, as the case may be, may be provided, which are adapted to different ranges of staple fibre lengths. In the embodiment according to FIG. 1 the distance between exit opening 17 and combing-in zone 11 must be chosen correspondingly to the staple length.

The distance of cover 15 or 23, as the case may be, from the tips of the fitting of separating drum 10, in the region of detaching and accelerating section 18 or 22. as the case may be, is less than 1 mm and expediently increases gradually, when a detaching section 24 is present, up to the end of the latter until it reaches a value of several millimetres.

The longitudinal axes of knitting needles 3 within combing-in zone 11 are in an attitude relative to separating drum 10 which lies between the radial and the tangential, in order to place the reception areas of knitting needles 3, determined by the distances of the open latches from the lower edges of hooks 4, optimally in the combing-in zone for the insertion of the fibres. At the same time knitting needles 3 can be given a hook form 4 which is more openly designed in comparison with traditional knitting needles and therefore offers only little resistance to the insertion of fibres 8. In place of the latch needles represented, tubular or slide needles can also be effectively applied.

Hooks 14 of separating drum 10, according to FIGS. 1 and 2, consist of saw-tooth-shaped hooks. Instead conical hooks or needles 37, in accordance with FIGS. 4 to 6, may be provided. Hooks 14 of the axes of needles 37 can be inclined forwards (FIGS. 1 to 4) or backwards (FIGS. 5 and 6) in the direction of rotation. In addition, hooks 14 or needles 37 are expediently parts of a fitting or card wire means made entirely of steel.

In the embodiment according to FIG. 5, additionally to the air ducts described above, another blowing nozzle 38 is provided which directs an additional current of air acting, tangentially and in the direction of rotation of separating drum 10 in the region of said opening 39, on the fibres already present in hooks 4 of knitting needles 3, and orienting these fibres in the desired manner, at which knitting needles 3 leave the part of the housing enclosing combing-in zone 11. In order to avoid the production of air vortices in the back of knitting needles 3 and to permit the orientation of fibres of great staple length, side wall 40 of the housing, according to FIG. 5, is expediently provided at this point with a duct 41 open at the entrance and exit ends and placed in the extension of the current of air, which duct 41 leads into opening 39 and in which therefore the fibres can orient themselves tangentially to the outer surface of separating drum 10. At the same time blowing nozzle 38 is disposed outside the housing in such a way that the current of air generated thereby enters obliquely from outside inwards into channel 41.

In the embodiment illustrated in FIG. 6, instead of duct 41 a duct 42 which is covered at its outer end is provided in side wall 40, which duct coacts with a blowing nozzle 43 the axis of which substantially coincides with the axis of duct 42. The effect of duct 42 and nozzle 43 corresponds to that of duct 41 and nozzle 38, except for the different orientation of the fibres combed into hooks 4.

Furthermore the fibres, as indicated in FIG. 2, may, at a place situated behind combing-in zone 11 in the direction of travel of knitting needles 3, just before the loop-forming process, be influenced in the direction opposite to the action of blower nozzle 38 or 43, as the case may be, (FIGS. 5 and 6), and be wrapped around the shafts of knitting needles 3, since e.g. the edge of opening 29 is placed so close to the passing backs of knitting needles 3 that free passage of the tufts of fibres present in hooks 4 through opening 29 is hindered and the tufts, during the continued movement of knitting needles 3, are wound around the shafts of the latter. By this means, surprisingly, knit goods of the plush or loop pile kind can be produced, since the fibres are tied into the basic stitch like the plush threads in the production of loop plush.

According to FIG. 4 it is also possible for the housing or cover part bordering on combing-in zone 11 in the backs of knitting needles 3 to be provided with an extension 44 extending downwards in such a way that said extension 44 can be used as a hold-down part for knit goods 1. Similarly, the housing may possess an expansion 45 (FIG. 3) extending outwards beyond combing-in zone 11 in the direction of motion of knitting needles 3 in such a way that said expansion 45 can be used to shield the fibre web combed in in a preceding knitting system, so as to prevent said fibre web during the stripping of knitting needles 3 from being caught up again in the knitting system represented in FIG. 3 and getting entangled.

Instead of the described circular knitting machine a pile knitting machine or a special plush machine may be provided, in which case separating drum 10, covers 15 or 23, as the case may be, and the various zones or sections 11, 18, 22 or 23 are adapted to the conditions present in the specific case.

The invention is not restricted to the embodiments described, but can also be modified in various ways. Instead of feed rolls 7 as represented, any other known feed devices can be used, which e.g. have only one feed roll situated opposite a trough, or have supplementary stretch mechanisms or so-called porcupine rolls (e.g. U.S. Pat. Nos. 3896636 and 3896637).

Instead of or in addition to the described and represented covers and housing, covers and housing of different shape can be used provided these permit as nearly one hundred percent detachment of the fibres from separating drum 10 as possible in order to avoid build-up effects, and have a section which permits the necessary separation of the fibres as well as their acceleration to a speed substantially greater than the feed rate.

Moreover, the entrance and exit openings 16, 17 and 25 need not be enclosed an all sides by the corresponding covers extending in the peripheral direction of separating drum 10. Since the shielding only needs to be present, on account of the almost hundred percent fibre detachment in the region of exit opening 17 or 25 as the case may be, between the entrance and exit opening, these openings can also be defined by those entrance and exit gaps that are produced in the application of a finite cover between the initial and end segments and the circumference of the separating drum. Where finite covers are used, openings 19 and 29 or slits 20 and 30 as the case may be, for the passage of knitting needles 3 may be absent, since in this case the needles can be guided directly past the end segment of the cover.

Instead of ducts 41,42 coacting with blowing nozzles 38, 43, finally, orientation elements in the form of mechanical or electrostatic apparatuses may be provided. These orientation elements, like blower nozzles 38, 43 and ducts 41, 42, can be placed, instead of at the exit of combing-in zone 11, directly at the place where knitting needles 3 are stripped in order to form loops.

The drive motor for the separating drum is one that is independent of the knitting machine drive mechanism, and which can even be run with the knitting machine. e.g. circular knitting machine, shut off, so that when the knitting machine is started up the separating drum is already at the necessary high r.p.m. and maintains it until the knitting machine is again shut off. For this independent drive mechanism, of course, a second, separate drive motor is not absolutely necessary, but it can be provided that with the aid of special gears and/or clutches it is ensured that the knitting machine can operate properly only with the separating drum running. Otherwise, shut-down areas would be produced in the goods which have no fibres or have unevenly distributed fibres. The necessary "high" r.p.m.'s of the separating drum in test machines were 4000 r.p.m. for a separating drum diameter of 125 mm and conditions otherwise similar to those present in the application of traditional separating devices.

In the embodiments hitherto described the fibre input, especially where very short fibres with a staple length of e.g. 20 mm are used, is not always satisfactory. For this case, moreover, the primary losses of fibres resulting from the fact that uninserted fibres escape unprocessed from flow channel 21 (FIG. 1) are undesirably high. In order to avoid these effects, embodiments according to FIG. 7 to 12 are especially suitable.

First, the erbodiment according to FIG. 7 contains, like the embodiment according to FIG. 2, a separating drum 51 fitted with hooks that is rotatable in the direction of arrow P, with the tips of the hooks lying on broken line 52. It also contains a feed apparatus 53 for feeding a band of fibres 8 and a cover 54 around the outer surface of separating drum 51, which has a separating and accelerating section 55 and a detaching section 56 adjacent thereto which opens into an exit slot formed by the exit gap between cover 54 and separating drum 51, which opening is adjoined by combing-in zone 11 running parallel to the axis of separating drum 51 and through which the hooks of knitting needles 3 pass. Cover 54, in the vicinity of detaching section 56, possesses, in correspondence with FIG. 4, an additional suction opening 58 comprising e.g. a slit extending over the entire width of separating drum 51 and running tangentially thereto. This suction opening 58, unlike FIG. 4, is not connected to a blowing nozzle, but solely to the external atmosphere. The orientation nozzles represented in FIGS. 5 and 6 are absent.

The guiding of the escaping air described in connection with FIGS. 1 to 6, which follows combing-in zone 11 in the direction of rotation of separating drum 51, in the area situated in the backs of knitting needles 3 is so chosen according to FIG. 7 that the part of cover 54 extended over and beyond combing-in zone 11 is designed as a guiding section 59 for air and fibres which divides the current of escaping air into a principal current 60 emerging into the outside atmosphere and a secondary current 61 flowing into the space between guiding section 59 and the outer surface of separating drum 51. Here guiding section 59 with its forward end 62, which is turned towards combing-in zone 11 and preferably rounded acts as the dividing edge. Forward end 62 preferably extends close to the backs of knitting needles 3 which in their fully extended position are present in combing-in zone 11, and is expediently placed in the region of combing-in zone 11 or the extension of exit opening 57. Guiding section 59 also possesses a guiding surface 63 on the side towards separating drum 51, which surface acts as an orientating and combing surface for the inserted tufts of fibres 64.

The radial distance of front end 62 or of the front end of guiding surface 63 from circle 52 is less than the radial distance of part 65 of detaching segment 56 bordering on exit opening 57, but is greater than the radial distance of separating and accelerating section 55 from the circle 52. The trailing end 66 of guiding surface 63, on the other hand, is substantially the same distance from circle 52 as separating and accelerating section 55, so that fibres which are carried along by separating drum 51 as far as trailing end 66 remain caught, as separating drum 51 continues to turn, in its hooks and cannot be thrown out of them in an uncontrolled fashion. For the same purpose section 67 of cover 54 that follows trailing end 66 and extends as far as feed apparatus 53 is also placed at such a distance from separating drum 51. The part of guiding surface 63 between forward end 62 and trailing end 66 expediently possesses a radial distance from the separating drum that decreases gradually along a concave surface in the direction of trailing end 66, so that guiding surface 63 forms a wedge-shaped gap with circle 52, i.e. with the tips of the hooks of the fitting on separating drum 51.

In order to form a flow channel for principal flow 60, finally, a channel section 68 can be provided which begins after combing-in zone 11 about at the level of part 65 and borders on principal current 60 more or less tangentially to the outer surface of separating drum 51. Correspondingly tangentially disposed is a lower surface 70 of guiding section 59 in FIG. 7. which begins at the forward end 62 of guiding section 59 and together with section 68 constitutes a flow duct for principal current 60.

The effect of secondary current 61, surprisingly, is that all inserted tufts of fibre 64, during their passage through combing-in zone 11, sooner or later come to be situated in the gap between guiding surface 63 and separating drum 51 and there are disposed parallel to the outer surface of separating drum 51.

This holds true even when the forward end 62 of guiding section 59 according to FIG. 7 is practically at the top end of combing-in zone 11, or exit opening 57, as the case may be. It is assumed, however, that this arrangement or orientation of tufts of fibres 64 is due less to the mere division of the stream of fibres and air into a principal flow 60 and a secondary flow 61 than to the fact that the principal flow 60 exiting to the atmosphere shows a rapidly decreasing flow velocity, while secondary flow 61 entering the narrowing wedge-shaped gap shows a velocity that increases continuously up to the end of the gap, so that especially in the vicinity of forward end 62 a stronger suction is exerted that draws even those tufts of fibres 64 which were originally pointed in the direction of main current 60 through the slit between forward end 62 and the backs of the needles into the wedge-shaped gap.

Once the tufts of fibres 64 are in the wedge-shaped gap, then by reason of the flow prevailing therein they move progressively towards the vicinity of the hooks on the fitting of separating drum 51 and are therefore seized by these hooks, combed and oriented, whereby the uniformity of the fibre density in the finished knitted fabric is substantially improved.

If, owing to the described combing and orientating effect, individual fibres should remain hanging in the hooks of separating drum 51 or are not at first inserted at all into the needle hooks, these fibres are conveyed by the separating drum for a full turn and are then reintroduced into combing-in zone 11. In this way the primary fibre loss, even where very short fibres are used, is reduced to a very small value of e.g. less than two percent. Surprisingly, however, not only are the primary losses of fibres small, but the secondary losses resulting from the combing out of the finished knitted fabric are also indeed less even than in fabrices with combed-in fibres knitted in the traditional way.

The combing out of tufts of fibres 64 and the revolving of combed-out fibres on separating drum 51 does indeed result in a slight impairment of the separating quality compared with embodiments according to FIGS. 1 to 6 and a short-term increase in the accumulation effect. This is balanced, however, by a substantial reduction in the primary loss of fibres, a considerable improvement in the uniformity of fibre insertion and a decided saving of energy owing to the elimination of blowing and/or suction nozzles.

Since knitting needles 3, on account of parts 65 of cover 53, must have a comparatively long extension stroke in order to bring their heads close to line 52 inside combing-in zone 11, the lifting cam in this area has additionally a guide 71 that supports knitting needles 3 during their ascension.

The embodiment according to FIG. 8, in which only the parts essential for guiding the spent air are represented, contains a separating drum 72, rotatable in the direction of arrow P, with hooks 73 that are inclined backwards and therefore have negative pitch, and the tips of which are disposed on a circle 74, and also a cover 75 with a detachment zone 76, a fibre- and air-guiding section 77 and a channel section 78. In contrast of FIG. 7, the radial distance of detachment section 76 from the outer surface of separating drum 72 does not increase continuously as far as an exit opening 79, but remains substantially constant or even decreases slightly again within a guiding section 81 extending from a place 80 to exit opening 79, so that immediately before exit opening 79 an abrupt barrier or ramp is formed by which the detached fibres are forcibly transported towards open hooks 4 of knitting needles 3. Behind knitting needles 3 the stream of air and fibres, owing to guiding section 77 as in FIG. 7, is divided into a principal current 82 and a secondary current 83. Unlike FIG. 7, however, guiding surface 84, on the side of separating drum 72, does not follow a concave course, but approaches separating drum 72 substantially in a plane, so as, when the smallest radial distance is reached, to merge into a not-represented section of cover 75 corresponding to section 67 (FIG. 7). As FIG. 8 shows, the free ends of inserted tufts of fibres 85 increasingly attain the region of influence of hooks 73 of separating drum 72 are therefore combed and orientated by these hooks.

In the especially advantageous embodiment according to FIG. 9 there are, as in FIG. 8, a separating drum 86 rotatable in the direction of arrow P, a cover 87 with a separating and accelerating section 88, a detachment section 91 with a ramplike guide part 89 and a suction opening 90, and an exit opening 92. An air- and fibre-guiding section 93 behind knitting needle 3 consists of a swivellable flap 94 of which the guide surface 95 facing separating drum 86 is designed substantially as in FIG. 7 and which, at least at its forward rounded end 96 acting as a separating edge, has a streamlined profile, wherein the stream of air and fibres emerging from exit opening 92 is divided into a main stream and a secondary stream.

The various sections of cover 87 may, as in FIGS. 1 to 6, be parts of a housing completely enclosing separating drum 86, which housing also possesses side walls 97, of which only the rear side wall is represented in FIG. 9. These side walls, according to FIG. 9, have a V-shaped downwardly opening wedge-shaped slot 98 for the admission of knitting needles 3, and the forward edge 96 of flap 94 extends into this slot. A channel section bounding the main current is lacking in this embodiment, so that during operation knitting needles 3 are visibly and easily accessible and troubles can be quickly recognized and remedied.

The rearward end 99 of flap 94 is swivellably mounted in side walls 97 so that the distance of guide surface 95 from a circle 100 generated by the tips of the fitting can be adjusted to any desired value, i.e. can be adapted to the circumstances of the specific case. The section of cover 87 bordering on the rearward end 99 of flap 94 is designed in accordance with FIGS. 7 and 8. The axis of swivelling is parallel to the axis of separating drum 86.

The embodiments according to FIGS. 7 to 9 result in uniform fibre input and low fibre loss even with the processing of short fibres. These desirable results are promoted above all by the special guiding of the spent air in combination with the ventilation produced by the separating drum and the suction opening and the negative angle at which the hooks of the separating run are set, which above all promotes a rapid and complete detachment of the fibres from the fitting. In tests the r.p.m. of the separating drum was 4000 for a separating drum diameter of 125 mm, while the other operation conditions were comparable with those that are customary in the application of traditional systems comprising separating and doffer drums. Guide section 81 or 89, as the case may be also, contributes to the attainment of low fibre losses, since they guide the fibres directly towards the open needle hooks.

With regard to the dimensioning of the embodiments described in terms of FIGS. 7 to 9 it may be said, essentially, that although all dimensions depend in one way or another on the kind and/or length and/or density of the fibres employed, they can be so chosen that they are suitable for a multiplicity of differing fibres. For example, the length of guide surfaces 63, 84 or 95, as the case may be, depends primarily on the length of fibre, but it can be chosen so that it corresponds to the longest staple length to be dealt with. On the other hand the distance of the guide surface from the separating drum must be adjusted, primarily, as a function of the fibre length and the density of the inserted tufts of fibres, so that these tufts are combed and oriented in the desired manner, on the one hand, but are not, on the other hand, torn out of the needle hooks or damaged.

Hereinafter, with reference to FIGS. 10 and 11, a number of dimensions are given which are suitable for a wide range of applications and a multiplicity of fibres, but without the invention being restricted to these dimensions. The distances of guide surfaces 63, 84 or 95, as the case may be, from circles 52, 74 and 100 respectively are about 1 mm as a maximum at a place 101, about 3 mm maximum at a place 102 and directly at the forward end, i.e. at a place 103, about one third the radial diameter of exit opening 92, maxumum, the distance of places 101 and 103 apart corresponds approximately to the average length of fibre.

In order to obtain as loss-free an input of fibres into hooks 4 of knitting needles 3 as possible, the needle heads in combing-in zone 11 should be brought close to circles 52, 74 or 100 as the case may be. For the dimension 104 represented in FIG. 11 values of about 2 mm maximum have been found especially favourable. The distance of the front side of knitting needles 3 to the end of guide section 89 adjacent to exit opening 92, corresponding to dimension 105, is expedient about 5 mm maxumum, and size 106 (FIG. 11), coresponding to the distance of the backs of the needles from the forward end of the guide surface is preferably about three times the height of a needle head, maximum. The length of the detachment section 56, 75 or 91 as the case may be, should span an angle of at least about 100°. The most suitable dimensions can easily be determined in the individual case.

For conversion of a circular knitting machine furnished with traditional carding mechanisms to a circular knitting machine according to the invention, the embodiment according to FIG. 12 is particularly suitable. This corresponds to the embodiments according to FIG. 9 except for a comparatively thin-walled guide section 107 which acts, like guide section 81 or 89 as the case may be, as an abrupt barrier or ramp and takes little room below. The separating drum, therefore, can be mounted very close to the knitting machine, so that even after conversion only a slight out-camming of needles is necccessary for seizure of the fibres.

Embodiments according to FIGS. 7 to 11 can also be modified in various ways. In place of swivellable flap 94, for example, a slidable air- and fibre-guiding section may be provided, and different sections may be used instead of the ramp-like like or the abrupt barrier like section and the channel sections. The form of the guide surface can also be chosen differently from the represented form of the forward end of the air- and fibre-guiding section.

In an especially advantageous embodiment of the invention the fittings 13 of the separating drum comprise a spirally wound-carding cloth having carding wires or individually inserted essentially rigid needles or hooks, like hooks 37,73, which needles or hooks are also inserted in a spiral manner. "Spiral" here means the pitch of a single-thread worm, e.g. like a winding staircase, Other arrangements of hooks or fittings tend to cause flocculation, which is undesirable.

Finally, each card, each separating drum, or at least each combing-in zone, can be divided into two sections that are spaced apart in the direction of the knitting or hosiery knitting needles, while the latter are so governed by means of common selector devices that the fibres from the first section are combed only into the first, third, fifth, etc. needles and those from the second section only into the intervening second, fourth, etc. needles. Such a 1:1 selection would have the advantage that the needles, in ejection position inside a combing-in zone are spaced farther apart and they do not receive any fibres that extend transversely over several needles, which would impair the quality of the finished knit goods. Similarly, there can, if required, be three or more such sections, which would call for a 1:2, 1:3, etc. selection of needles, and would also, of course, entail a considerable widening of the combing-in zone.

As already mentioned above, the peripheral speed of separating drum 10 is always greater than the peripheral speed of needle cylinder 2 and hence is also greater than the needle speed effected by the rotation of needle cylinder 2. In order to maintain a uniform introduction of fibres into the needles under these circumstances, in an especially preferred embodiment of the invention the width of the separating drum is at least equal to five times, preferably at least equal to ten times the needle interval, the needle interval being measured, in accordance with the calculation of the spacing of a circular knitting machine, from each needle centre to needle centre. At the same time the set-up according to FIG. 3 is designed so that combing-in zone 11, in the direction of rotation of the needle cylinder begins ahead of separating drum 10 and ends behind it. As a result not only are at least five and preferably at least ten needles at all times in a spaced opposite separating drum 10, but all these needles also pass separating drum 10 on section 26 of path 27 in the extended attitude. Thereby it is achieved that all needles move past the entire width of separating drum 10 always in the extended attitude, and therefore can receive the fibres delivered into the combing-in zone from all sections of the separating drum in the same way.

The embodiments of the invention in which an exclusive property or privilege is claimed are defined as follows:

1. A circular knitting machine for the manufacture of knit goods with combed-in fibres, having at least one rotary needle cylinder supporting movable knitting needles, a drive for rotating said needle cylinder and at least one carding machine comprising a feed apparatus for a band of fibres, a combing-in zone, through which the knitting needles pass and in which the fibres are inserted contactlessly into the needles, and a separating apparatus for receiving said band of fibres, separating the band of fibres into individual fibres and transporting said fibres to the combing-in zone, characterized in that the separating apparatus comprises a separating drum having card wire means, said drum being driven independently of said drive for rotating the needle cylinder and being driven with a peripheral speed which is substantially greater than the needle speed effected by rotation of the needle cylinder, and that the separating apparatus further comprises a cover opposite the peripheral surface of the separating drum, which cover has an entrance opening for the band of fibres fed by the feed apparatus and an exit opening for the separated fibres that opens into the combing-in zone, which cover so closely embraces the card wire means along a separating and accelerating section between the entrance opening and the exit opening in the direction of rotation, that detachment of the fibres from the separating drum within this separating and accelerating section is prevented.

2. A machine according to claim 1, wherein said cover embraces the card wire means along a detachment section with a radial distance such that detachment of the fibres from the separating drum is possible, said detachment section being provided between the separating and accelerating section and the exit opening.

3. A machine according to claim 1, in which the separating drum is adapted to be driven at such a high angular velocity that the fibres are automatically loosened from the card wire means in the region of the exit opening and then transported through the exit opening.

4. A machine according to claim 2, in which the separating drum is adapted to be driven at such a high angular velocity that the fibres are automatically loosened from the card wire means in the region of the detachment section and then transported through the exit opening.

5. A machine according to claim 2, in which the cover has a further opening for blowing a stream of air through the detachment section in the direction of the combing-in zone for promoting or effecting the detachment of the fibres.

6. A machine according to claim 1, in which the cover is part of a housing enclosing the separating drum on all sides at least between the entrance opening and the exit opening.

7. A machine according to claim 1 or 2, in which the combing-in zone is disposed parallel to the axis of the separating drum.

8. A machine according to claim 1 or 2, in which the card wire means are rigid hooks.

9. A machine according to claim 1 or 2, wherein the card wire means are rigid needles.

10. A machine according to claim 2, in which the separating and accelerating section and the detachment section have lengths corresponding to the maximum lengths of the staple fibres.

11. A machine according to claim 1 or 2, in which the cover has an air and fibre guiding section disposed behind the combing-in zone, which section has a forward end towards the combing-in zone that acts as a separating edge dividing the stream of air emerging from the exit opening into a main stream to the atmosphere and a secondary stream passing between the guiding section and the separating drum and has a guiding surface facing towards the separating drum and acting as an orientating and combing surface for the tufts of fibre inserted into the needles.

12. A machine according to claim 11, in which said forward end of the guiding section has a radial distance from the separating drum that is less than the radial distance from the drum of a part of the detachment section adjacent to the exit opening, and that is greater than the radial distance from the drum of the separating and accelerating section, and in which the guiding section has a trailing end on the side opposite to the combing-in zone which trailing end has a radial distance from the separating drum that is substantially equal to the radial distance from said drum of the separating and accelerating section.

13. A machine according to claim 12, in which the part of the guiding surface located between said forward end and said rearward end has a radial distance from the separating drum that decreases gradually from the forward to the rearward end.

14. A machine according to claim 12, in which said forward end of the guiding section is rounded on the side towards the combing-in zone.

15. A machine according to claim 11, wherein the guiding section is shiftably mounted.

16. A machine according to claim 11, in which the guiding section comprises a flap having a rearward end remote from the combing-in zone, said rearward end being pivotably mounted.

17. A machine according to claim 2 or 4, in which the detachment section has a radial distance from the separating drum which—starting at the separating and accelerating section—first increases and then, in the direction of the exit opening remains constant.

18. A machine according to claim 2 or 4, in which the detachment section has a radial distance from the separating drum which - starting at the separating and accelerating section - first increases and then, in the direction of the exit opening again decreases.

19. A machine according to claim 2 or 4, in which the detachment section has a part adjacent to the exit opening which part is an abrupt barrier or a ramp.

20. A machine according to claim 6, in which the housing also extends to the area of the combing-in zone and has side walls, each side wall having a slot for the knitting needles to pass through.

21. A machine according to claim 20, in which one of the said side walls has a duct adjacent to the slot on a side rearward to the combing-in zone, and in which a blowing nozzle is provided for blowing an air stream into the duct, to orientate the fibres which were combed into the needles at the combing-in zone.

22. A machine according to claim 1 or 2, in which the width of the separating drum is equal to at least five times, the needle interval calculated from the needle spacing.

23. A machine according to claim 1 or 2, wherein the combing-in zone begins ahead of the separating drum, in the direction of rotation of the needle cylinder, and ends behind it.

* * * * *